United States Patent [19]

Wilson

[11] 4,092,888

[45] June 6, 1978

[54] SELF-STRIPPING PUNCH AND GUIDE ASSEMBLY

[75] Inventor: Kenneth J. Wilson, Roseville, Minn.

[73] Assignee: Wilson Tool Company, St. Paul, Minn.

[21] Appl. No.: 812,128

[22] Filed: Jul. 1, 1977

[51] Int. Cl.[2] ..... B26F 1/14

[52] U.S. Cl. ..... 83/140; 83/143; 83/588

[58] Field of Search ..... 83/140, 138, 143, 588, 83/635, 698

[56] References Cited

U.S. PATENT DOCUMENTS

| | | | |
|---|---|---|---|
| 3,114,280 | 12/1963 | Schott | 83/140 |
| 3,958,476 | 5/1976 | Bartha | 83/143 |
| 4,007,653 | 2/1977 | Cady | 83/140 |
| 4,031,787 | 6/1977 | Cady | 83/140 |

*Primary Examiner*—Donald R. Schran
*Attorney, Agent, or Firm*—Burd, Braddock & Bartz

[57] ABSTRACT

A punching device for use in a fixed frame adapted to support punch means in alignment with a ram. An assembly of a punch, a guide and stripper plate and a stripping spring is removable as a unit. The assembly of this invention is characterized by means by which the assembly is retained together when removed from the frame of the punching machine. The assembly includes a quick release guide, a clip ring spring support retainer and a replaceable stripper plate.

4 Claims, 6 Drawing Figures

SELF-STRIPPING PUNCH AND GUIDE ASSEMBLY

BACKGROUND OF THE INVENTION

1. Field of the Invention

This invention relates to a self-stripping punch and guide assembly for use in a punch press, or the like. Various types of frames or tool supports form a part of a punch press frame or are mounted thereon so that the tooling used with the press is in alignment with the ram of the press or can be moved into alignment with the ram. The tooling is desirably removable manually for disassembly and sharpening, replacement of a punch, or the like. In order to do this most efficiently, it is desirable that all components of the punch assembly be held together as they are being removed and replaced.

2. The Prior Art

In order to retain the punch assembly components together, it has been known to use a set screw to keep the guide sleeve loosely attached to the punch. U.S. Pat. No. 3,958,476 discloses a punch assembly in which the guide sleeve has a circumferential groove in which there is a radial aperture and a retainer member disposed in that groove with a portion that projects through the radial aperture and retains the punch by engagement with an elongated recess in the punch body. U.S. Pat. No. 4,007,653 shows another form of punch assembly in which the punch body is maintained in the guide by virtue of a friction member disposed in a circumferential groove in the punch body.

SUMMARY OF THE INVENTION

The present invention is directed to a punch assembly having novel retainer means for maintaining the assembly together, quick release of the guide sleeve for disassembly and novel replaceable stripper means. The punching assembly is intended for use in a machine having a frame with a lower arm supporting a die and an upper arm having a vertical bore aligned with the die. The guide sleeve of the assembly is adapted for slidable disposition in the bore in the upper arm of the machine. That guide sleeve has a circumferential groove immediately adjacent to its upper end and has a resilient O-ring in that groove for retaining a spring support collar. The punch has a head and a body slidably disposed in the guide sleeve. The punch body has a circumferential groove spaced from the ends of the body and a retaining ring is disposed in that groove. The outside diameter of the ring is greater than the outside diameter of the punch body so that when assembled, the ring projects beyond the outside diameter of the punch. The spring support collar which is releasably attached to the guide sleeve is slidably disposed on the punch body. That collar in normal at-rest position engages the top surface of the projecting periphery of the retaining ring by virtue of a stripping spring disposed between the collar and the punch head. The collar has a downwardly extending annular flange which engages the upper end of the guide sleeve and is held there by virtue of the O-ring in the groove on that sleeve.

The guide sleeve includes stripper means for facilitating withdrawal of the punch from the work. In the preferred form, the stripper means is a replaceable plate or disc disposed in an annular recess at the bottom end of the guide sleeve and retained therein by means of a retaining ring disposed in a peripheral groove in the recess.

BRIEF DESCRIPTION OF THE DRAWINGS

The invention is illustrated in the accompanying drawings in which.

DETAILED DESCRIPTION OF THE PREFERRED EMBODIMENT

Figure 1:
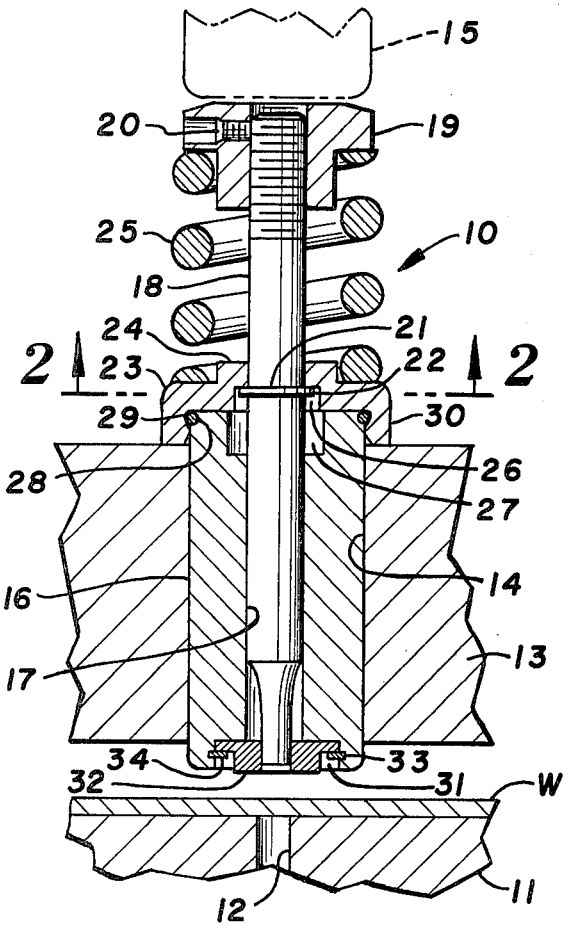
FIG. 1 is a vertical elevation in section showing one form of punch assembly in place in a machine such as a punch press.

Referring now to the drawings and particularly to FIG. 1, the punch assembly, indicated generally at 10, is shown in place in a machine, such as a punch press, which has a lower arm or portion 11 which has a die aperture 12 over which a work piece W is disposed. The machine frame also includes an upper arm 13 having a vertical bore 14 in axial alignment with the die aperture. The machine also includes a ram 15 overlying the vertical bore. The tooling is prevented from jumping out of the bore during stripping by the presence of the ram and no structure is necessary for holding the punch assembly together during operation. However, during removal, handling and reinstallation, it is desirable that the assembly be held together as a unit.

The punch assembly includes guide sleeve 16 which is supported in bore 14 as hereinafter described. The guide sleeve has a central bore 17 in which a punch 18 is disposed for slidable reciprocal movement. The upper end of the punch body is externally threaded and an internally threaded head 19 is attached thereto and locked in place by means of a set screw 20.

The punch body has a circumferential groove 21 spaced from the ends of the body. A flat retaining ring 22 is disposed in groove 21. This ring is of the type, for example, of that sold by Anderton-Darby, Inc. of Clifton, N.J. as type 1408, or similar retaining rings available from a number of other sources. The outside diameter of retaining ring 22 is greater than the diameter of the punch body such that the peripheral edge of the ring when seated in groove 21 projects beyond the surface of the punch body.

A spring support collar 23 is slidably disposed on the punch body. Collar 23 includes an annular projection 24 on its top surface which functions as a seat for stripping spring 25 whose opposite end is seated on the punch head 19. The bottom surface of collar 23 has an annular recess 26 whose diameter is somewhat greater than the diameter of retaining ring 22. When the collar is in normal at-rest position, it is in engagement with retaining ring 22. Thus the stripping spring and spring support collar are maintained in assembly with the punch body. When spring 25 is compressed by action of ram 15 against head 19, the punch body slides downwardly relative to collar 23, retaining ring 22 moving downwardly relative to recess 26. When the force of the ram is removed and the parts moved back to their original positions, the collar resumes its normal at-rest position in engagement with the retaining ring 22. Utilization of the retaining ring assures a positive stop and repeatable positioning between the spring support collar and punch body. The use of a retaining ring offers the additional advantages of lower cost of punch body manufacture and better control of quality due to elimination of some operator adjusted set screws.

Figure 4:
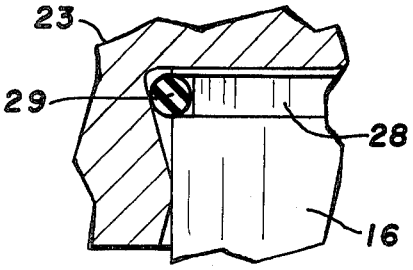
FIG. 4 is a fragmentary section on an enlarged scale showing details of construction of the spring support collar.

The mechanism by which the punch and spring assembly is attached to the guide sleeve is as follows: Guide sleeve 16 is provided with a circumferential groove 28 immediately adjacent to its top end. A resilient rubber, synthetic rubber, synthetic resinous plastic (such as nylon) or metallic O-ring 29 is disposed in that groove. Spring support collar 23 is provided with a downwardly extending annular flange 30 which fits over the upper end of guide 16 and is frictionally engaged by O-ring 29. As best seen in FIG. 4, the inner surface of flange 30 is generally arcuate in contour providing a slightly flaring mouth into which the end of the guide is inserted and a seat into which the resilient O-ring may expand to firmly and securely hold collar 23 in engagement with the guide 16. As seen in FIG. 1, the end of flange 30 forms a shoulder for supporting the punch assembly in bore 14 in frame member 13. The guide may be easily removed from the spring support collar in a quick release manner by a fast longitudinally applied pull. Utilization of this quick release guide enables the user to sharpen punches without time consuming disassembly and eliminates some operator adjusted set screws conventionally used.

The bottom end of guide 16 is provided with an annular recess 31. A replaceable circular stripper plate or disc 32 is seated in recess 34. The stripper plate is held in place by means of a resilient retaining ring 34 seated in a peripheral groove 33 in the wall of the recess. The retaining ring, for example, may be Anderton-Darby type 1308 or equivalent ring obtainable from other manufacturers. The use of a replaceable stripper plate eliminates the need for complete replacement of a guide each time a different size or shape punch is required. This offers substantial savings to the user.

Figure 5:
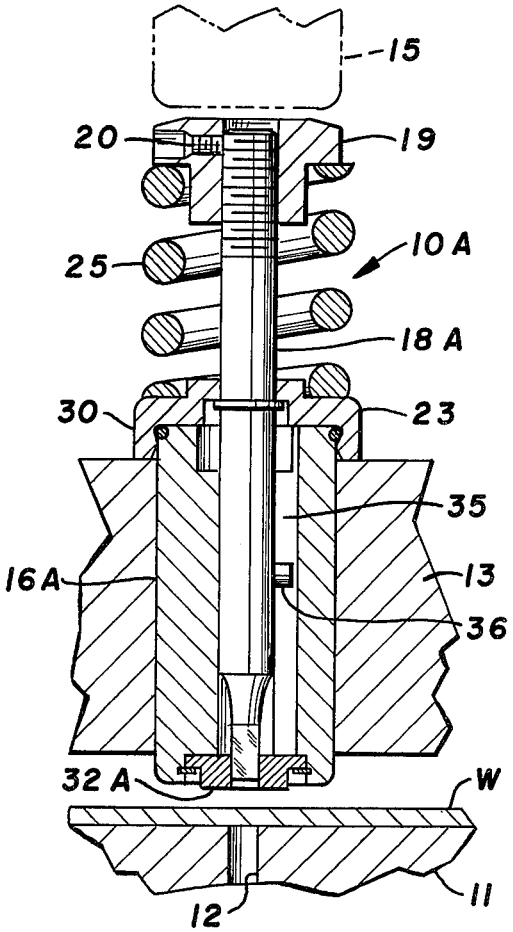
FIG. 5 is a vertical elevation in section showing another form of punch assembly.
Figure 2:
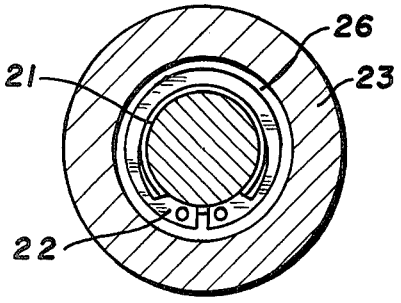
FIG. 2 is a fragmentary transverse section on the line 2—2 of FIG. 1 and in the direction of the arrows.
Figure 3:
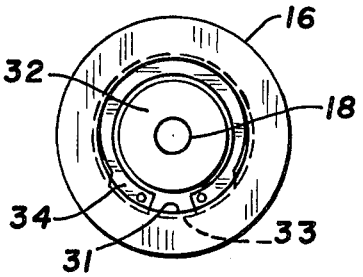
FIG. 3 is a bottom plan view of the assembly of FIG. 1.
Figure 6:
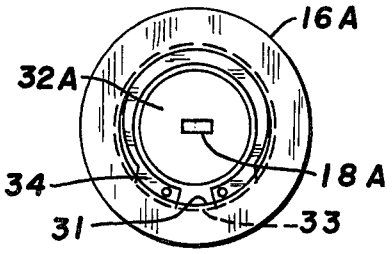
FIG. 6 is a bottom plan view of the assembly of FIG. 5.

The punch of the assembly of FIGS. 1 through 3 is adapted to punching circular holes. Accordingly, it is not material whether or not the punch body rotates relative to the guide. FIGS. 5 and 6 show an alternative form of punch assembly 10A in which the punch is adapted to forming of non-circular holes. In order to insure that the punch, die aperture and stripper aperture remain in registry, it is necessary that means be provided to prevent rotation between the punch body and the guide. This embodiment is identical in all respects except that alternative guide 16A is provided with an inner vertical channel 35 and alternative punch 18A is provided with a radially extending key or other guide projection 36 which engages channel 35 and reciprocates therein to prevent rotation. The aperture in replaceable stripper plate 32A then corresponds to the particular geometry of the cutting end of the punch.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A punching device for use in a machine having a frame with a lower portion supporting a die and an upper portion having a vertical bore aligned therewith, said punching device comprising:

A. a guide sleeve adapted for slidable disposition in the bore in the upper portion of said machine frame, said sleeve having a circumferential groove adjacent its upper end, and a resilient retaining means in said groove, B. a punch having a head and a body slidably disposed in said sleeve, said body having a circumferential groove spaced from the ends of the body, C. a retaining ring disposed in said punch body groove, the outside diameter of said ring being substantially greater than the diameter of the punch body whereby the periphery of the ring projects beyond the periphery of the body, D. a spring support collar slidably disposed on said punch body in normal engagement with the projecting periphery of the retaining ring, said collar having a downwardly extending annular flange in engagement with the upper end of the guide sleeve and the retaining means therein, E. a stripping spring acting between said collar and punch head, and F. stripper means disposed in the bottom end of the guide sleeve.

2. A punching device according to claim 1 wherein the inner wall surface of said annular flange is generally arcuate in contour.

3. A punching device according to claim 1 wherein said retaining means in the circumferential groove at the upper end of the guide sleeve is a resilient O-ring.

4. A punching device according to claim 1 wherein:

A. the bottom end of said guide sleeve is provided with an annular recess,

B. said recess has a peripheral groove therein,

C. a replaceable stripper plate is disposed in said recess, and

D. a retaining ring is disposed in said recess groove to retain said stripper plate in the recess.

* * * * *